United States Patent [19]

Tashiro et al.

[11] Patent Number: 4,721,746

[45] Date of Patent: Jan. 26, 1988

[54] FLAMEPROOFING SYNTHETIC FIBER

[75] Inventors: Mikio Tashiro; Nobuo Sakashita, both of Matsuyama; Yasunori Tatsuoka, Nagaokakyo; Tamio Mitamura, Kobe; Kazunori Orii, Kusatsu, all of Japan

[73] Assignee: Teijin Limited, Osaka, Japan

[21] Appl. No.: 899,144

[22] Filed: Aug. 22, 1986

[30] Foreign Application Priority Data

Aug. 29, 1985 [JP] Japan ..... 60-191375

[51] Int. Cl.[4] ..... C08K 5/52

[52] U.S. Cl. ..... 524/145; 524/467

[58] Field of Search ..... 524/141, 145, 133, 135, 524/118, 117, 467; 528/287; 264/331.21

[56] References Cited

U.S. PATENT DOCUMENTS

| | | | |
|---|---|---|---|
| 3,658,634 | 4/1972 | Yanagi et al. | 524/145 |
| 3,941,752 | 3/1976 | Kleiner et al. | 524/287 |
| 4,056,356 | 11/1977 | Gilkey et al. | 528/287 |
| 4,113,846 | 1/1979 | Albright | 528/287 |
| 4,116,702 | 9/1978 | Rohringer et al. | 524/93 |
| 4,127,590 | 11/1978 | Endo et al. | 528/287 |
| 4,280,951 | 7/1981 | Saito et al. | 528/287 |

*Primary Examiner*—Veronica P. Hoke

*Attorney, Agent, or Firm*—Cushman, Darby & Cushman

[57] ABSTRACT

Disclosed is a flameproofing synthetic fiber comprising a halogenated cycloalkane and at least one member selected from phosphorus compounds represented by the following general formulae (I) through (IV):

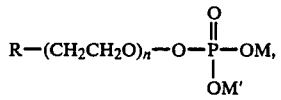

(I)

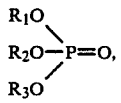

(II)

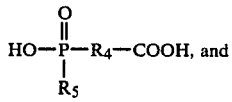

(III)

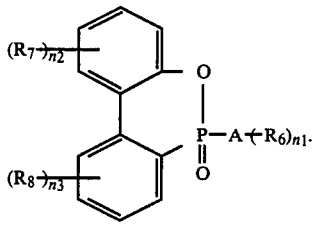

(IV)

According to the present invention, the flameproofing synthetic fiber which is excellent in flameproofing property and feeling and significantly improved in spinning property and corrosion protective property can be provided. Furthermore, the foaming during operation and the passing processability through a stuffing crimper are also extremely improved.

6 Claims, No Drawings

FLAMEPROOFING SYNTHETIC FIBER

BACKGROUND OF THE INVENTION (1) Field of the Invention

The present invention relates to a flameproofing synthetic fiber, particularly to a flameproofing synthetic fiber comprising a halogenated cycloalkane and a specific phosphorus compound.

(2) Description of the Prior Art

Various methods for providing flameproofing synthetic fibers by applying flameproofing agents to the synthetic fibers have conventionally been proposed. Particularly, U.S. Pat. No. 4,116,702 discloses that a flameproofing synthetic fiber treated with a flameproofing agent which contains a brominated cycloalkane having 7 to 12 ring-constituent carbon atoms and 4 to 6 bromine atoms attached to the ring-constituent carbon atoms, a dispersant such as a lignin sulfonate, a protective colloid and water has an excellent flameproofing property.

Further, Japanese patent application Laid-open No. 36032/1984 describes a flameproofing agent prepared by dispersing a polybrominated organic compound such as a brominated cycloalkane in water without use of any dispersant, for the purposes of further enhancement of a flameproofing effect, and prevention of lowering of color fastness, discoloration on high temperature treatments, corrosion of metals and the like.

However, the above-mentioned halogenated cycloalkane compounds (hereinafter referred to as HCA for brevity) have a serious disadvantage that they corrode metals of HCA applying apparatus employed in the procedure of synthetic fiber manufacturing and apparatus for after-treatment of the synthetic fibers applied with HCA, such as heat-treatment apparatus, cutters, packaging apparatus, spinning machines and so on.

Further, aqueous dispersions of HCA have a disadvantage that they extremely deteriorate the passing processability through crimping apparatus such as stuffing crimpers, when they are applied prior to the crimping treatment in the procedure of synthetic fiber manufacturing, because they have a function for increasing the frictional coefficient. Thus, the function for increasing the frictional coefficient causes various troubles such as the inferior passing processability of the fibers through cards, clogging induced by the fibers in coiler tubes and the like, also in the spinning process in which the synthetic fibers are converted to the spun yarns. Furthermore, there are problems that remarkable forming in the aqueous dispersion causes deterioration of the workability and a large amount of white powder is produced in the spinning process.

On the other hand, Japanese Patent Publication No. 22958/1974 discloses a flameproofing polyester containing a phosphate represented by the following general formula:

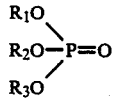

wherein each of $R_1$, $R_2$ and $R_3$, which may be the same or different, is a substituted or unsubstituted aryl, alkyl or cycloalkyl group.

Further, Japanese patent application Laid-open No. 56488/1975 and Japanese Patent Application Laid-open No. 82392/1976 disclose a flameretardant polyester including a phosphorus compound represented by the following general formula:

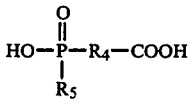

wherein $R_4$ is a saturated, open-chain or cyclic alkylene, arylene or aralkylene group, and $R_5$ is an alkyl, aryl or aralkyl group having 6 or less carbon atoms.

Japanese patent application No. 47891/1977 also describes a flameresistant polyester containing a phosphorus compound represented by the following general formula:

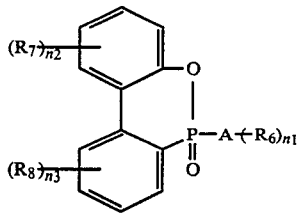

wherein $R_6$ is a monovalent, ester-forming functional group, each of $R_7$ and $R_8$, which may be the same or different, is a hydrocarbon group having 1 to 10 carbon atoms or $R_6$, A is a divalent or trivalent organic group, $n_1$ is an integer of 1 or 2, and each of $n_2$ and $n_3$ is an integer of 0 to 4.

When the phosphorus compounds described above are contained in the polyesters, improvement of the flameproofing property is found, but its extent is insufficient. Therefore, further improvement of the flameproofing property has been requested.

SUMMARY OF THE INVENTION

The primary object of the present invention is to provide a flameproofing synthetic fiber excellent in feeling and flameproofing property, overcoming the disadvantages described above, namely, improving the workability, processability and spinning property in the procedure of synthetic fiber manufacturing and further reducing corrosion of the apparatus.

In accordance with the present invention, there is provided a flameproofing synthetic fiber comprising a halogenated cycloalkane and at least one member selected from phosphorus compounds represented by the following general formulae (I) through (VI):

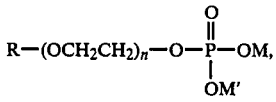

(I)

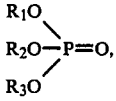

(II)

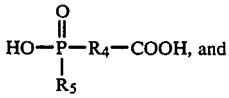

(III)

-continued (IV)

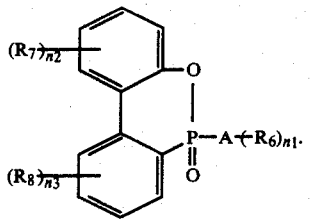

DESCRIPTION OF THE PREFERRED EMBODIMENTS

As the synthetic fiber used in the present invention, there can be mentioned known synthetic fibers such as polyester fibers, polyamide fibers, polyacrylonitrile fibers, polyolefin fibers and polyvinyl chloride fibers. Particularly, in the case of the polyester fibers, the preferred results can be obtained in durable flameproofing property and feeling. The fibers may be in staple form or in continuous filament form. In particular, the fibers in staple form provide excellent effects. The fiber cross section may take any shapes such as circular hollow, noncircular solid and noncircular hollow shapes, without being limited to circular solid shape.

As examples of HCA (A) applied to the synthetic fiber of the present invention, there can be mentioned 1,2,3,4,5,6-hexabromocycloheptane, 1,2,3,4-tetrabromocyclooctane, 1,2,4,6-tetrabromocyclooctane, and 1,2,5,6,9,10-hexabromocyclododecane. Particularly, in the case of the polyester fiber, 1,2,5,6,9,10-hexabromocyclododecane is preferably used, because the excellent adhesive fastness of the flameproofing agent to the fiber, the excellent flameproofing property and feeling can be obtained.

Since HCA is a solid insoluble in water, it is solved in a solvent such as perchloroethylene or toluene, or dispersed in water for use. When an aqueous dispersion of HCA is prepared, HCA is ground in such a manner that the particles have an average diameter of less than 1 μm, and then stirred for mixing with water and a protective colloid in a ball mill and the like for several hours. Thus, the aqueous dispersion excellent in dispersion stability can be obtained. The particles of HCA are preferable to be less than 1 μm in average diameter, in terms of the dispersion stability of the aqueous dispersion, the adhesive efficiency and adhesive fastness of the flameproofing agent to the fiber.

The protective colloid is exemplified by polyvinyl alcohol, polyvinyl pyrrolidine, methyl cellulose, carboxymethyl cellulose, hydroxyethyl or hydroxypropyl cellulose, gelatins, acid casein, starch paste or polymers of monomers of the acrylic acid series, for example polyacrylic acid, ethyl acrylate or methylmethacrylate copolymers. Good results are obtained above all with polyvinyl alcohol, hydroxyethyl cellulose and, especially, with carboxynethyl cellulose.

Considering the flameproofing property, feeling and spinning property of the fibers, an amount of the protective colloid used in the aqueous dispersion is desirable to be minimized. The protective colloid is preferable to be used in an amount of not more than 1% by weight, based on the weight of HCA.

In the present invention, at least one of the phosporus compounds (B) represented by the formulae (I) through (IV) is used together with the foregoing HCA (A). The foregoing phosphorus compound (B) is applied on the synthetic fiber, and/or blended in the polymer constituting the synthetic fiber or copolymerized therewith.

Particularly, it is preferable that the phosphorus compound (B) represented by the formula (I) is applied on the synthetic fiber by dipping the synthetic fiber in the liquor containing HCA (A) and the phosphorus compound (B) represented by the formula (I) as will hereinafter described.

In the foregoing general formula (I) representing the phosphorus compound (B), R is an alkyl group having 6 to 30 carbon atoms on an average, each of M and M', which may be the same or different, is hydrogen or an alkali metal, and n is an integer of 0 to 30. If the average carbon number of R is less than 6, the heat resistance of the fiber is deteriorated and the frictional resistance between fibers after the heat-set treatment is too increased. Therefore, such a compound is unsuitable. On the other hand, if the average carbon number of R exceeds 30, the foaming induced at the treating bath in drawing process can not be prevented to cause deterioration of the workability. Particularly, the average carbon number of R is preferable to be in the range of 8 to 20. Further, if the mole number n of added ethylene oxide exceeds 30, the heat resistance of the fiber is deteriorated and the frictional resistance between fibers after the heat-set treatment is too increased. Therefore, such a compound is unsuitable. Also when ethylene oxide is not added, namely, when n equals 0, the effects of the present invention can be achieved. However, it is preferable that ethylene oxide is added, because the dispersibility of the phosphorus compound represented by the formula (I) is maintained and the foaming induced in the treating bath during operation is reduced. The mole number of added ethylene oxide is particularly desirable to be in the range of 1 to 20.

Such a phosphorus compound (B) can be obtained by reacting with phosphoric anhydride a higher alkyl alcohol wherein the average carbon number of the alkyl group is in the range of 6 to 30 or an alkyl ether prepared by adding thereto not more than 30 moles of ethylene oxide. In this case, a phosphoric ester or its salt having an acid value of 0 to 70, preferably, 0 to 50 is favorably used, which is prepared by neutralizing an acidic phosphoric ester having a degree of phosphoration (the gram-atom number of phosphorus atoms attached to 1 mole of an alcohol) of 0.2 to 2.0 with an inorganic alkali hydroxide. As the higher alkyl alcohol wherein the average carbon number of the alkyl group is in the range of 6 to 30, there can be mentioned, for example, octyl alcohol, decyl alcohol, dodecyl alcohol, tetradecyl alcohol, hexadecyl alcohol, octadecyl alcohol and docosa alcohol. These alcohols may be used alone, respectively, or as mixtures thereof. Further, the alcohol may be straight-chain or branched-chain, and saturated and/or unsaturated. Polyoxyethylene alkyl ether is exemplified by POE (2 moles) octyl ether, POE (7 moles) octyl ether, POE (2 moles) nonyl or isononyl ether, POE (7 moles) nonyl or isononyl ether, POE (10 moles) nonyl or isononyl ether, POE (7 moles) dodecyl ether, POE (12 moles) dodecyl ether, POE (5 moles) hexadecyl ether and POE (10 moles) hexadecyl ether and so on.

If the acid value of the foregoing phosphorus compound (B) is too high, it is observed that the antistatic property and the heat resistance of the fiber tend to decrease. If the degree of phosphoration is too high, the inorganic phosphate increases to cause the high frictional resistance between fibers. On the other hand, if the degree of phosphoration is too low, a large amount of the unreacted alcohol or polyoxyethylene alkyl ether remains in the reaction mixture. The alkali hydroxide used in neutralization includes hydroxides of alkali metals such as lithium, sodium and potassium. In terms of the antistatic poperty, potassium hydroxide is particularly preferred.

It is further preferable that the phosphorus comounds represented by the formulae (II) through (IV) are blended in the polymer constituting the synthetic fiber and/or copolymerized therewith.

With respect to such phosphorus compounds, in the foregoing general formula (II), each of $R_1$, $R_2$ and $R_3$, which may be the same or different, is a substituted or unsubstituted aryl, alkyl or cycloalkyl group. $R_1$, $R_2$ and $R_3$ include aryl groups such as phenyl, naphthyl and biphenyl; substituted aryl groups such as tolyl, nonylphenyl, ethoxyphenyl and methoxyphenyl; alkyl groups such as methyl, ethyl, butyl, octyl and nonyl; substituted alkyl groups such as ethoxyethyl and butoxyethyl; cycloalkyl groups such as cyclohexyl and decahydronaphthyl; and substituted cycloalkyl groups such as methylcyclohexyl and the like. As the phosphorus compound (B) represented by the general formula (II), there can be mentioned, for example, trimethyl phosphate, triethyl phosphate, tributyl phosphate, trioctyl phosphate, trinonyl phosphate, tributoxyethyl phosphate, triphenyl phosphate, butyldiphenyl phosphate, methyldiphenyl phosphate, octyldiphenyl phosphate, cyclohexyldiphenyl phosphate, naphthyldiethyl phosphate and methylcyclohexyldiethyl phosphate.

As to the foregoing general formula (III), $R_4$ is a saturated, open-chain or cyclic alkylene, arylene or aralkylene group, and $R_5$ is an alkyl, aryl or aralkyl group having 6 or less carbon atoms. $R_4$ includes open-chain alkylene groups such as methylene, ethylene, propylene, isopropylene, butylene and isobutylene; cyclic alkylene groups such as cyclohexylene and the like; arylene groups such as phenylene and the like; and aralkylene groups such as methylphenylene and the like. $R_5$ includes open-chain alkyl groups such as methyl, ethyl, butyl and isobutyl; cyclic alkyl groups such as cyclohexyl and the like; aryl groups such as phenyl and the like; aralkyl groups such as benzyl and the like.

Further, with respect to the foregoing general formula (IV), $R_6$ is a monovalent, ester-forming functional group, each of $R_7$ and $R_8$, which may be the same or different, is a hydrocarbon group having 1 to 10 carbon atoms or $R_6$, A is a divalent or trivalent organic group, $n_1$ is an integer of 1 or 2, and each of $n_2$ and $n_3$ is an integer of 0 to 4.

As $R_6$, there can be mentioned carboxyl groups; alkyl, cycloalkyl and aryl esters of carboxyl groups with 2 to 7 carbon atoms; hydroxyl groups; hydroxylalkoxycarbonyl groups; and a group represented by the formula $$-\overset{O}{\overset{\|}{C}}-O-\overset{O}{\overset{\|}{C}}-.$$

As $R_7$ and $R_8$, there can be preferably mentioned alkyl groups with 1 to 6 carbon atoms; cycloalkyl groups; aryl groups; and monovalent groups or $R_6$ described above.

On the other hand, A preferably includes lower alkylene groups such as methylene, ethylene, 1,2-propylene and 1,3-propylene; arylene groups such as 1,3-phenylene and 1,4-phenylene; divalent groups such as 1,3-xylylene, 1,4-xylylene and

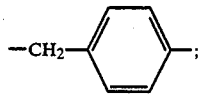

trivalent groups represented by the formula

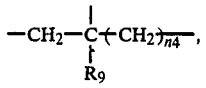

wherein $R_9$ is a hydrogen atom or a lower alkyl group such as methyl, ethyl or the like, and $n_4$ is 0 or 1; and;

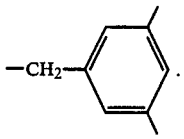

When HCA (A) and the phosphorus compound (B) represented by the foregoing general formula (I) are used to obtain the flameproofing synthetic fiber of the present invention, both are applied on the synthetic fiber.

It is preferable that the flameproofing synthetic fiber of the present invention has HCA (A) and the phosphorus compound (B) represented by the general formula (I) deposited thereon in an amount of 0.5 to 7.0% by weight, preferably, 1.5 to 4.0% by weight, based on the weight of the synthetic fiber. If the amount of HCA (A) and the phosphorus compound (B) is too small, the flameproofing property becomes insufficient. On the other hand, if the amount thereof is too large, it is observed that white powders are produced to tend to deteriorate the spinning property of the fiber. A ratio of HCA (A) to the phosphorus compound (B) represented by the general formula (I) is preferable to be in the range of 70:30 to 98:2. Too little phosphorus compound tends to lower the corrosion preventive effect and to deteriorate the passing processability through a stuffing crimper and the spinning property. On the contrary, too much phosphorus compound is liable to cause remarkable foaming in the treating bath and detrioration of compatibility with the aqueous dispersion of HCA (A), because the phosphorus compound (B) does not act as a dispersant for HCA (A).

When HCA (A) and the phosphorus compound (B) represented by the general formula (II), (III) or (IV) are employed for producing the flameproofing synthetic fiber of the present invention, the phosphorus compound (B) is incorporated in the synthetic fiber and HCA (A) is applied on the synthetic fiber. In this case, it is preferable that the flameproofing synthetic fiber of the present invention has the phosphorus comound (B) represented by the foregoing general formula (II), (III) or (IV) incorporated therein in an amount of 0.05 to 5% by weight and HCA (A) applied thereon 0.2 to 8% by weight, based on the weight of the synthetic fiber. It is observed that too little HCA (A) tends to cause the insufficient flameproofing property and too much HCA (A) is liable to deteriorate the spinning property of the synthetic fiber caused by the generation of white powders, whereas too little phosphorus comound (B) also tends to cause the insufficient flameproofing property and too much phosphorus compound (B) is liable to deteriorate the melt-spinning processability of the synthetic fiber and further result in lowering of the mechanical properties of the synthetic fiber caused by the decrease of the polymerization degree on melt spinning.

The flameproofing synthetic fiber of the present invention is desirable to be crimped for the purpose of improvement of the spinning property.

It is preferable that the number of crimps is 10 to 18 crimps per 25mm of the fiber, particularly 12 to 15 crimps per 25 mm of the fiber, and the percentage crimp is 8 to 38%, particularly 10 to 20%. The crimps may be not only planer, but also three-dimensional in shape, as obtained by the conjugate spinning process, the unsymmetrical cooling spinning process or the like.

For producing the flameproofing synthetic fiber of the present invention by the combination of HCA (A) and the phosphorus compound (B) represented by the foregoing general formula (I), the synthetic fiber may be treated with the aqueous dispersion containing HCA (A) and the phosphorus compound (B) above described, prior to the crimping in the procedure of synthetic fiber manufacturing.

The aqueous dispersion may be applied to the synthetic fiber in the undrawn state immediately after the melt spinning or in the state after the drawing, so long as it is applied prior to the crimping. The aqueous dispersion is preferable to be applied to the synthetic fiber, while the synthetic fiber is still in the undrawn state, because HCA (A) sufficiently penetrates into the inside of the synthetic fiber so as to be favorably prevented from the elimination in the spinning, dying and weaving processes.

When the flameproofing synthetic fiber of the present invention is produced by the combination of HCA (A) and the phosphorus compound (B) represented by the foregoing formula (II), (III) or (IV), the phosphorus compound (B) is blended in the synthetic polymer and/or copolymarized therewith before the melt spinning, while HCA (A) is imparted to the melt-spun synthetic fiber as the aqueous dispersion.

The phosphorus compound (B) can be incorporated in the synthetic polymer in any step. For example, in the case that the phosphorus compound (B) is copolymerized with the polyester, the phosphorus compound (B) may be added on the ester interchange reaction, after the ester interchange reaction and before the condensation polymerization reaction, or in a relatively early stage of the condensation polymerization reaction. Further, in the case that the phosphorus compound (B) is blended in the synthetic polymer, the phosphorus compound (B) is added after the conclusion of the polymerization reaction and before the melt spinning.

The melt spinning of the synthetic polymer containing the phosphorus compound (B) can be conducted in the usual way.

The synthetic fiber thus obtained is treated with the aqueous dispersion containing HCA (A). This aqueous dispersion may be applied to the synthetic fiber in an arbitrary stage, but is preferable to be applied thereto, while the synthetic fiber is still in the undrawn state, as is the case with the foregoing aqueous dipspersion containing HCA (A) and the phosphorus compound (B) represented by the general formula (I). It is preferable to use the phosphorus compound (B) represented by the general formula (I) together with HCA (A) in the aqueous dispersion, because the foaming induced in the treating bath is depressed, and the corrosion preventive property, the passing processability through a stuffing crimper and the spinning property are also highly improved.

The aqueous dispersion containing HCA (A) may contain an ultraviolet absorbent such as a compound of the benzotriazole series so far as the object of the present invention is not failed to be achieved. Flameproofing agents other than HCA can also be used therewith to such an extent that the spinning property, feeling and the like of the synthetic fiber are not inhibited. When the treating bath is liable to foam, a slight amount of antifoaming agent can be used therewith so far as the flameproofing property is not impaired. Further, after the aqueous dispersion of HCA is applied on the synthetic fiber, dried, fixed by heating and then washed with water at need, another oiling agent for enhancing the spinning property can be applied to the synthetic fiber by the spray method, the padding method and the like, if necessary.

The aqueous dispersion containing HCA can be applied to the synthetic fiber by any conventional method, for example, by dipping, padding, spraying or oiling roller coating.

The synthetic fiber treated with the aqueous dispersion containing HCA (A) is heat treated at a temperature of at least 130° C., preferably at least 155° C., for at least 30 seconds, preferably at least 10 minutes, thereby HCA (A) being allowed to penetrate into the inside of the synthetic fiber. This heat treatment may also be used for the heat treatment to set the crimps.

The present invention will now be described in detail with reference to the following examples. In the following examples, the add-on of the treating agent on the synthetic fiber, the flameproofing property, the adhesive fastness of HCA to the synthetic fiber, the spinning property, the feeling, the stability of the treating liquor, the foaming during operation, the passing processability through a stuffing crimper, the corrosion protective property and the crimp properties were evaluated by the following methods:

(1) The add-on of the treating agent on the synthetic fiber

The add-on of the treating agent on the synthetic fiber=(Weight of treating agent/weight of fiber)×100% by weight (2) The flameproofing property The washing by water in the flameproofing test method of the Japanese fire protection law was repeated 5 times, wherein the water hardness was adjusted by 75 ppm with calcium chloride, and then the number of flame contact was determined as a mean value of 5 samples according to Japanese Industial Standard (JIS) L-1091 D method. The number of flame contact is more, the flameproofing property is better. The number of flame contact permissible in practical use is at least 2, preferably at least 3.

(3) The adhesive fastness of HCA to the synthetic fiber

The adhesive fastness of *HCA* on dry cleaning =

-continued $$\frac{\text{Amount of } HCA \text{ applied on fiber after dry cleaning}}{\text{Amount of } HCA \text{ applied on fiber before dry cleaning}} \times 100\%$$

With respect to the above value, at least 50% was defined as "GOOD" (marked by O), and less than 50% was defined as "inferior" (marked by X).

(4) The spinning property

The spinning property was evaluated by the occurrence of clogging induced by the fibers in coiler tubes when 10 Kg of fibers was carded.

No occurrence of clogging was defined as "GOOD" (marked by O), the case that the coiling became impossible by clogging was defined as "inferior" (marked by X), and the case that the spinning was somehow possible, lying between both, was defined as "approximately good" (marked by Δ).

(5) The feeling

"GOOD" (marked by "O) and "inferior" (marked by X) were judged by the touch.

(6) The foaming during operation

In the circulation tank, the dipping treating bath and the like, the case that the foaming was remarkable was defined as "inferior" (marked by X), the case that no problem occurred was defined as "GOOD" (marked by O), and the case that the extent of foaming lay between both was defined as "ordinary" (marked by Δ).

(7) The passing processability through a stuffing crimper

The case that the stuffing crimper could not be normally operated, accompanied with rattling, was defined as "inferior" (marked by X), the case that the crimper could be operated almost without problem was defined as "GOOD" (marked by O),and the operating condition of the crimper lay between both was defined "ordinary" (marked by Δ).

(8) The corrosion protective property

An appropriate amount of the treating liquor was placed in a test tube, and an iron nail was immersed therein. When allowed to stand for a whole day and night, the case that rust was generated on the surface of the nail was defined as "inferior" (marked by X), the case that no rust was generated was defined as "GOOD" (marked by O), and the intermediate state between both was defined as "ordinary" (marked by Δ).

(9) The crimp properties

The crimp number and the percentage crimp of the flameproofing synthetic fiber was measured in accordance with Japanese Industrial Standard (JIS) L-1015.

EXAMPLES 1 to 8

45 parts of 1,2,5,6,9,10-hexabromocyclododecane (hereinafter referred to as HBCD for brevity) having an average particle size of 0.5 μm, 0.5 part of carboxymethyl cellulose having an average molecular weight of 400,000 as the protective colloid and 54.5 parts of water were ground and mixed in a ball mill for 5 hours to produce an aqueous dispersion of HBCD wherein effective ingredient of 45% by weight was contained and which viscosity is 4,500 centipoises when measured by a rotary B type viscometer. 44 parts of the resultant aqueous dispersion was brought up to 100 parts as a whole by adding aqueous solutions of various phosphate compounds shown in Table 1 to prepare various treating baths, respectively.

On the other hand, polyethylene terephthalate tows of 450,000 deniers were drawn to 3.5 times in a hot water bath of 90° C. to produce drawn tows having a monofilament fineness of 2 deniers. The drawn tows was dipped in and passed through the foregoing various treating baths, and thereafter crimped by a stuffing crimper in such a manner that the crimp number of 12 crimps/25 mm and the percentage crimp of 12% could be obtained. As well as crimping, the treating liquor contained in the tows was squeezed in such a manner that the add-on of the treating agents shown in Table 1 could be obtained. The tows were subsequently heat treated under relaxation by a continuous dryer at 170° C. for 15 minutes, and then cut in length of 51 mm to prepare the staple fibers.

The staple fibers thus obtained were spun to spun yarns of 30/2, and the yarn dyeing was carried out by a package dyeing machine under the following two conditions:

| | |
|---|---|
| (A) Dye composition; | |
| Resolin Blue FBL | 0.5% owf |
| Disper VG | 0.2 g/l |
| Acetic acid | 0.2 g/l |
| Treating condition; | |
| Bath ratio | 1:20 |
| Temperature | 130° C. |
| Time | 30 minutes |
| (b) Dye composition; | |
| Dianix Red BN-SN | 0.5% owf |
| Disper VG | 0.2 g/l |
| Acetic acid | 0.2 g/l |
| Treating condition; | |
| Same as in (A) | |

Two kinds of dyed yarns thus obtained were woven to a jacquard fabric having the weight of 400 g/m$^2$ by a jacquard weaving machine. The fabrics were scoured in a bath containing 0.5 g/l of the nonionic surfactant (Scourol 400#) in a bath ratio of 1:20 at a temperature of 80° C. for a period of 10 minutes. Then, the flameproofing property, the adhesive fastness of HBCD, the spinning property and the feeling of the resultant fabrics were determined. The stability of the various treating liquors, the corrosion protective property, the foaming during operation and the passing processability through a stuffing crimper were also evaluated. The results obtained were as shown in Table 2.

COMPARATIVE EXAMPLE 1

The treatment was conducted in the same manner as in Example 1 with the exception that the phosphate compound (B) was not used.

COMPARATIVE EXAMPLES 2 to 4

The treatments were conducted in the same manner as in Example 1 with the exception that HBCD as a flameproofing agent was substituted for Antiblaze 19 (supplied by Mobile Chemical Co., cyclic phosphate, effective ingredient of 100%) as Comparative Example 2, for an emulsion of tris(2,3-dichloropropyl)phosphate (effective ingredient of 45%) as Comparative Example 3 and for an emulsion of tetrabromobisphenol A (effective ingredient of 45%) as Comparative Example 4. The results obtained were also shown in Table 2.

As apparent from Table 2, the synthetic fibers of the present invention comprising HCA (A) and the phosphorus compound (B) (Examples 1 to 8) were excellent in flameproofing property, adhesive fastness of HBCD, spinning property, feeling and corrosion protective property and passing processability through a stuffing crimper, and further the treating liquors used in the present invention were stable and the foaming thereof was little. On the contrary, when the phosphorus compound (B) was not contained (Comparative Example 1), the spinning property, the corrosion protective property and the passing processability were deteriorated. When the other conventional flameproofing agents were used instead of HBCD (Comparative Examples 2 to 4), the fibers were lowered in not only flameproofing property, but also in adhesive fastness of the flameproofing agent, spinning property and feeling.

TABLE 1-continued

| | Composition of treating agent | | Add-on of treating agent % | | (A)/(B) |
|---|---|---|---|---|---|
| | (A) | (B) | (A) | (B) | ratio |
| Example 4 | | | | | |

*1 S.P.K: potassium stearyl phosphate,
*2 C.P.K: potassium cetyl phosphate,
*3 L.P.K: potassium lauryl phosphate,
*4 C(10).P.K: polyoxyethylene (10 moles) adduct of potassium cetyl ether phosphate,
*5 N(7).P.K: polyoxyethylene (7 moles) adduct of potassium nonyl ether phosphate,
*6 D(12).P.K: polyoxyethylene (12 moles) adduct of potassium dodecyl ether phosphate,
*7 H(5).P.K: polyoxyethylene (5 moles) adduct of potassium hexadecyl ether phosphate,
*8 O(2).P.K: polyoxyethylene (2 moles) adduct of potassium octyl ether phosphate.

TABLE 2

| | Flameproofing property | Adhesive fastness of flameproofing agent | Spinning property | Feeling | Corrosion protective property | Foaming during operation | Passing processability through stuffing crimper |
|---|---|---|---|---|---|---|---|
| Example 1 | 4.0 | O | O | O | O | O | O |
| Example 2 | 4.2 | O | O | O | O | O | O |
| Example 3 | 4.0 | O | O | O | O | O | O |
| Example 4 | 4.0 | O | O | O | O | Δ | O |
| Example 5 | 4.2 | O | O | O | O | O | O |
| Example 6 | 4.2 | O | O | O | O | O | O |
| Example 7 | 4.0 | O | O | O | O | O | O |
| Example 8 | 4.0 | O | O | O | O | O | O |
| Comparative Example 1 | 4.0 | O | X | O | X | O | X |
| Comparative Example 2 | 1.4 | X | X | X | O | X | X |
| Comparative Example 3 | 1.8 | X | X | X | O | X | X |
| Comparative Example 4 | 1.6 | X | X | X | O | X | X |

TABLE 1

| | Composition of treating agent | | Add-on of treating agent % | | (A)/(B) |
|---|---|---|---|---|---|
| | (A) | (B) | (A) | (B) | ratio |
| Example 1 | HBCD | *1 S.P.K | 2.5 | 0.15 | 94/6 |
| Example 2 | HBCD | *2 C.P.K | 2.5 | 0.20 | 93/7 |
| Example 3 | HBCD | *3 L.P.K | 2.5 | 0.35 | 88/12 |
| Example 4 | HBCD | *4 C(10).P.K | 2.5 | 1.0 | 72/28 |
| Example 5 | HBCD | *5 N(7).P.K | 2.5 | 0.2 | 93/7 |
| Example 6 | HBCD | *6 D(12).P.K | 2.5 | 0.4 | 86/14 |
| Example 7 | HBCD | *7 H(5).P.K | 2.5 | 0.6 | 81/19 |
| Example 8 | HBCD | *8 O(2).P.K | 2.5 | 0.8 | 76/24 |
| Comparative Example 1 | HBCD | — | 2.5 | 0 | 100/0 |
| Comparactive Example 2 | [Antiblaze 19] | *1 S.P.K | 2.5 | 0.15 | 94/6 |
| Comparative Example 3 | [Tris(2,3-dichloropropyl)phosphate] | *1 S.P.K | 2.5 | 0.15 | 94/6 |
| Comparative | [Tetrabromobisphenol A] | *1 S.P.K | 2.5 | 0.15 | 94/6 |

EXAMPLES 9 and 10

The treatments were conducted in the same manner as in Example 4 with the exception that HBCD waS substituted for 1,2,3,4-tetrabromocyclooctane (Example 9) and for 1,2,3,4,5,6-hexabromocycloheptane (Example 10). The results were as shown in Table 3. The fibers obtained in each Example showed good properties.

TABLE 3

| HCA | Example 9 Tetrabromocyclooctane | Example 10 Hexabromocycloheptane |
|---|---|---|
| Flameproofing property | 4.0 | 4.0 |
| Adhesive fastness of flameproofing agent | O | O |
| Spinning property | O | O |
| Feeling | O | O |
| Corrosion preventive property | O | O |
| Foaming during operation | O | O |
| Passing processability through stuffing crimper | O | O |

EXAMPLES 11 to 21

The synthetic fibers deposited with various amounts of HCA (A) and the phosphorus compound (B) and various ratios of HCA (A) to the phosphorus compound (B) as shown in Table 4 were prepared by varying a mixing ratio of HCA (A) and the phosphorus compound (B) in the treating bath in Example 7. The results were as shown in Tables 4 and 5.

As apparent from Tables 4 and 5, it is preferable that a total amount of HCA (A) and the phosphorus compound (B) deposited on the synthetic fibers is in the range of 0.5 to 7.0% by weight, preferably, 1.5 to 4.0% by weight, in terms of the flameproofing property and the spinning property. A ratio of HCA (A) to the phosphorus compound (B) is preferable to be in the range of 70:30 to 98:2, in terms of the spinning property, the corrosion protective property, the passing processability through a stuffing crimper and the foaming of the treating bath during operation.

TABLE 4

| | Add-on of treating agent % | | | (A)/(B) | Flame-proof-ing prop-erty | Adhesive fastness of flame-proofing agent |
|---|---|---|---|---|---|---|
| | (A) | (B) | Total | ratio | | |
| Example 11 | 1.82 | 0.98 | 2.8 | 65/35 | 3.8 | O |
| Example 12 | 2.02 | 0.78 | 2.8 | 72/28 | 3.8 | O |
| Example 13 | 2.46 | 0.34 | 2.8 | 88/12 | 4.0 | O |
| Example 14 | 2.69 | 0.11 | 2.8 | 96/4 | 4.4 | O |
| Example 15 | 2.77 | 0.03 | 2.8 | 99/1 | 4.6 | O |
| Example 16 | 0.35 | 0.05 | 0.4 | 88/12 | 2.2 | O |
| Example 17 | 0.62 | 0.08 | 0.7 | 88/12 | 2.6 | O |
| Example 18 | 1.32 | 0.18 | 1.5 | 88/12 | 3.2 | O |
| Example 19 | 3.52 | 0.48 | 4.0 | 88/12 | 4.6 | O |
| Example 20 | 5.98 | 0.82 | 6.8 | 88/12 | 5.2 | O |
| Example 21 | 6.34 | 0.86 | 7.2 | 88/12 | 6.0 | O |

TABLE 5

| | Spinning property | Feeling | Corrosion protective property | Foaming during operation | Passing process-ability through stuffing crimper |
|---|---|---|---|---|---|
| Example 11 | O | O | O | Δ | O |
| Example 12 | O | O | O | Δ~O | O |
| Example 13 | O | O | O | O | O |
| Example 14 | Δ~O | O | Δ~O | O | Δ~O |
| Example 15 | Δ | O | Δ | O | Δ |
| Example 16 | O | O | O | O | O |
| Example 17 | O | O | O | O | O |
| Example 18 | O | O | O | O | O |
| Example 19 | O | O | O | O | O |
| Example 20 | Δ~O | O | O | O | O |
| Example 21 | Δ | O | O | O | O |

EXAMPLES 22 to 28

In Example 7, the fibers varied in crimp properties were prepared and the spinning property thereof was evaluated. The results were as shown in Table 6, and it was observer that the fibers having a crimp number of 10 to 18 crimps/25 mm and a percentage crimp of 8 to 38% showed the good spinning property.

TABLE 6

| | Crimp properties | | |
|---|---|---|---|
| | Crimp number (crimps/25 mm) | Percentage crimp (%) | Spinning property |
| Example 22 | 8 | 6 | Δ |
| Example 23 | 12 | 12 | O |
| Example 24 | 11 | 12 | Δ~O |
| Example 25 | 11 | 19 | Δ~O |
| Example 26 | 15 | 18 | O |
| Example 27 | 17 | 36 | Δ~O |
| Example 28 | 20 | 40 | Δ |

EXAMPLE 29

The mixture of 97 parts of dimethyl terephthalate, 69 parts of ethylene glycol, 0.09 part of calcium acetate and 0.03 part of antimony trioxide was heated at 165° C. to 220° C. until the distillation of methanol was completed. Then, 0.7 part of trimethyl phosphate and 0.99 part of p-diphenylcarboxylic acid were added thereto, and the reaction was continued under an atmosphere of nitrogen at 275° C. for 200 minutes, gradually reducing the pressure with the progress of the reaction, finally to 0.4 mm Hg.

The polyester thus obtained had an intrinsic viscosity of 0.64.

This polyester was melt spun in the usual way to obtain a tow of 450,000 deniers, and the tow was further drawn to 3.5 times in a hot water bath of 90° C. to produce a drawn tow having a monofilament fineness of 2 diniers.

On the other hand, 45 parts of HBCD having an average particle size of 0.5 μm, 0.5 part of carboxymethyl cellulose having an average molecular weight of 400,000 as the protective colloid and 54.5 parts of water were ground and mixed in a ball mill for 5 hours to produce an aqueous dispersion of HBCD wherein effective ingredient of 45% by weight was contained and which viscosity is 4,500 centipoises when measured by a rotary B type viscometer. 44 parts of the resultant aqueous dispersion was brought up to 100 parts as a whole by adding water.

The foregoing drawn tow was dipped in and passed through this treating bath, and thereafter crimped by a stuffing crimper in such a manner that the crimp number of 12 crimps/25 mm and the percentage crimp of 12% could be obtained. As well as crimping, the treating liquor contained in the tow was squeezed in such a manner that the treating agent were deposited on the tow in an amount of 1.0% by weight.

The tow was subsequently heat treated under relaxation by a continuous dryer at 170° C. for 15 minutes, and then cut in length of 51 mm to prepare the staple fibers. Trimethyl phosphate was contained in the staple fibers in an amount of 0.7% by weight.

The staple fibers thus obtained were spun to spun yarns of 30/2, and the yarn dyeing was carried out by a package dyeing machine under the following two conditions:

| | |
|---|---|
| (A) Dye composition; | |
| Resolin Blue FBL | 0.5% owf |
| Disper VG | 0.2 g/l |
| Acetic acid | 0.2 g/l |
| Treating condition; | |
| Bath ratio | 1:20 |
| Temperature | 130° C. |
| Time | 30 minutes |

-continued

| | |
|---|---|
| (B) Dye composition; | |
| Dianix Red BN-SE | 0.5% owf |
| Disper VG | 0.2 g/l |
| Acetic acid | 0.2 g/l |
| Treating condition; | |
| Same as in (A) | |

Two kinds of dyed yarns thus obtained were woven to a jacquard fabric having the weight of 400 g/m$^2$ by a jacquare weaving machine. The fabric was scoured in a bath containing 0.5 g/l of the nonionic surfactant (Scourol 400#) in a bath ratio of 1:20 at a temperature of 80° C. for a period of 10 minutes. Then, the flameproofing property, the adhesive fastness of HBCD, the spinning property and the feeling of the resultant fabric were determined. The stability of the treating liquor, the corrosion protective property, the foaming during operation and the passing processability through a stuffing crimper were also evaluated. The results obtained were as shown in Table 7.

COMPARATIVE EXAMPLE 5

The treatment was conducted in the same manner as in Example 29 with the exception that the tow was not treated with the treating bath containing HBCD.

COMPARATIVE EXAMPLE 6

The treatment was conducted in the same manner as in Example 29 with the exception that trimethyl phosphate was not added on the manufacture of the polyester.

COMPARATIVE EXAMPLES 7 to 9

The treatments were conducted in the same manner as in Example 29 with the exception that HBCD as a flameproofing agent was substituted for Antiblaze 19 (supplied by Mobile Chemical Co., cyclic phosphate, effective ingredient of 100%) as Comparative Exampl 7, for an emulsion of tris(2,3-dichloropropyl)phosphate (effective ingredient of 45%) as Comparative Exampl 8 and for an emulsion of tetrabromobisphenol A (effective ingredient of 45%) as Comparative Example 9. The results obtained were also shown in Table 7.

As apparent from Table 7, the synthetic fiber of the present invention comprising HCA (A) and the phosphorus compound (B) (Example 29) was excellent in flameproofing property, adhesive fastness of HCA, spinning property, feeling, corrosion protective property and passing processability through a stuffing crimper, and further the treating liquor was stable and the foaming thereof was little. On the contrary, when HCA (A) was not contained (Comparative Example 5) and the phosphorus compound (B) was not contained (Comparative Example 6), the flameproofing property was extremely deteriorated. When the other conventional flameproofing agents were used instead of HBCD (Comparative Examples 7 to 9), the fibers were lowered in not only flameproofing property, but also adhesive fastness of the flameproofing agent, spinning property and feeling.

TABLE 7

| | HCA (A) | Phosphorus compound (B) | Flame-proofing property | Adhesive fastness of flame-proofing agent |
|---|---|---|---|---|
| Example 29 | HBCD | Trimethyl phosphate | 4.2 | O |
| Comparative Example 5 | — | Trimethyl phosphate | 2.2 | O |
| Comparative Example 6 | HBCD | — | 2.8 | O |
| Comparative Example 7 | [Antiblaze 19] | Trimethyl phosphate | 2.2 | X |
| Comparative Example 8 | [Tris(2,3-dichloro-propyl)-phosphate] | Trimethyl phosphate | 2.2 | X |
| Comparative Example 9 | [Tetrabromo-bisphenyl A] | Trimethyl phosphate | 2.2 | X |

| | Spinning property | Feel-ing | Corrosion protective property | Foaming during operation | Passing process-abililty through stuffing crimper |
|---|---|---|---|---|---|
| Example 29 | Δ~O | O | Δ~O | O | Δ |
| Comparative Example 5 | Δ~O | O | O | — | O |
| Comparative Example 6 | Δ | O | Δ | O | Δ |
| Comparative Example 7 | X | X | O | X | X |
| Comparative Example 8 | X | X | O | X | X |
| Comparative Example 9 | X | X | O | X | X |

EXAMPLES 30 and 31

The treatments were conducted in the same manner as in Example 29 with the exception that HBCD was substituted for 1,2,3,4-tetrabromocyclooctane (Example 30) and for 1,2,3,4,5,6-hexabromocycloheptane (Example 31). The results were as shown in Table 8, and each showed good properties.

TABLE 8

| HCA | Example 30 Tetrabromo-cyclooctane | Example 31 Hexabromo-cycloheptane |
|---|---|---|
| Flameproofing property | 4.0 | 4.0 |
| Adhesive fastness of flameproofing agent | O | O |
| Spinning property | Δ~O | Δ~O |
| Feeling | O | O |
| Corrosion protective property | Δ~O | Δ~O |
| Foaming during operation | O | O |
| Passing process-ability through stuffing crimper | Δ | Δ |

EXAMPLE 32

The mixture of 1000 parts of dimethyl terephthalate, 798 parts of ethylene glycol and 0.23 part of manganese acetate was heated at 170° C. to 220° C. until the distillation of methanol was complete. Subsequently, the esterification was effected at 220° C. by adding 8 parts of 2-carboxyethyl-methylphosphinic acid. 0.35 part of antimony trioxide was thereafter added thereto, and the reaction was continued under an atmosphere of nitrogen at 275° C. for 180 minutes, gradually reducing the pressure with the progress of the reaction, finally to 0.2 mm Hg.

The polyester thus obtained had an intrinsic viscosity of 0.63.

By using this polyester, the staple fibers were prepared in the same manner as in Example 29. 2-Carboxyethyl-methylphosphinic acid was contained in the staple fibers in an amount of about 0.7% by weight and HBCD was applied on the staple fibers in an amount of 1.0% by weight.

The staple fibers thus obtained were spun, dyed and woven in the same manner as in Example 29, and the same items as those in Exmaple 29 were evaluated. The results obtained were as shown in Table 9.

EXAMPLE 33

The mixture of 388 parts of dimethyl terephthalate, 248 parts of ethylene glycol, 3.5 parts of the phosphorus compound represented by the formula

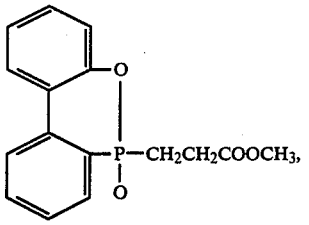

0.34 part of zinc acetate and 0.34 part of antimony trioxide was heated at 165° C. to 220° C. until the distillation of methanol was complete. The reaction was subsequently continued under an atmosphere of nitrogen at 275° C. for 160 minutes, gradually reducing the pressure with the progress of the reaction, finally to 0.2 mm Hg.

The polyester thus obtained had an intrinsic viscosity of 0.65.

By using this polyester, the staple fibers were prepared in the same manner as in Example 29. The phosphorus compound was contained in the staple fibers in an amount of about 0.9% by weight and HBCD was applied on the staple fibers in an amount of 1.0% by weight.

The staple fibers thus obtained were spun, dyed and woven in the same manner as in Example 29, and the same items as those in Example 29 were evaluated. The results obtained were as shown in Table 9.

COMPARATIVE EXAMPLES 10 and 11

The same treatments as those in Examples 32 and 33 were conducted with the exception that the treatment by the treating bath containing HBCD was omitted. The results were also shown in Table 9.

As apparent from Table 9, the synthetic fibers of the present invention comprising HBCD (A) and the phosphorus compound (B) (Examples 32 and 33) were excellent in flameproofing property, adhesive fastness of HBCD, spinning property, feeling, corrosion protective property and passing processability through a stuffing crimper, and further the treating liquors were stable and the foaming thereof was little. On the contrary, when HBCD(A) was not contained (Comparative Examples 10 and 11), the flameproofing property was extremely deteriorated.

TABLE 9

| | HCA (A) | Phosphorus compound (B) | Flame-proofing property | Adhesive fastness of flame-proofing agent |
|---|---|---|---|---|
| Example 32 | HBCD | 2-Carboxyethylmethylphosphinic | 4.0 | o |
| Example 33 | HBCD | 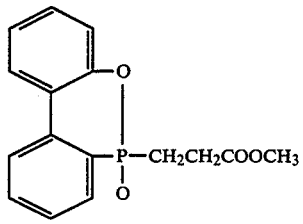 | 3.8 | o |
| Comparative Example 10 | — | 2-Carboxyethylmethylphosphinic acid | 2.2 | o |
| Comparative Example 11 | — | 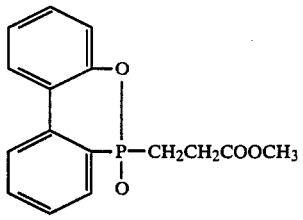 | 2.0 | o |

| | Spinning property | Feeling | Corrosion protective property | Foaming during operation | Passing process-ability through stuffing crimper |
|---|---|---|---|---|---|
| Example 32 | Δ~o | o | Δ~o | o | Δ |
| Example 33 | Δ~o | o | Δ~o | o | Δ |
| Comparative Example 10 | o | o | o | — | o |
| Comparative | o | o | o | — | o |

TABLE 9-continued

| Example 11 |
|---|

EXAMPLES 34 to 36

In Example 29, the treating baths which were brought up to 100 parts as a whole by adding aqueous solutions of various phosphate compounds shown in Table 10 to 44 parts of the aqueous solution containing HBCD were used. The results were as shown in Table 10. The addition of the phosphate compound represented by the foregoing general formula (I) caused the foaming of the treating bath to be depressed, and the corrosion protective property, the passing processability through a stuffing crimper and the spinning property to be remarkably improved.

TABLE 10

| | Composition of treating bath | | | | |
|---|---|---|---|---|---|
| | HCA (A) | Phosphate compound | Ratio of HCA (A) / Phosphate compound (B) | Flameproofing property | Adhesive fastness of flameproofing agent |
| Example 34 | HBCD | (1) | 94/6 | 4.4 | O |
| Example 35 | HBCD | (2) | 93/7 | 4.4 | O |
| Example 36 | HBCD | (3) | 81/19 | 4.4 | O |

| | Spinning property | Feeling | Corrosion protective property | Foaming during operation | Passing processability through stuffing crimper |
|---|---|---|---|---|---|
| Example 34 | O | O | O | O | O |
| Example 35 | O | O | O | O | O |
| Example 36 | O | O | O | O | O |

As hereinbefore described, according to the present invention, by allowing the synthetic fiber to comprise the specific phosphorus compound in addition to HCA, the flameproofing synthetic fiber which is excellent in flamproofing property and feeling and significantly improved in spinning property and corrosion protective property can be provided. Furthermore, the stability of the treating liquor, the foaming during operation and the passing processability through a stuffing crimper in the procedure of synthetic fiber manufacturing are also extremely improved.

The flameproofing synthetic fiber of the present invention is extremely useful for textile, filling, interior, nonwoven fabric, artificial leather and artificial fur uses.

What is claimed is:

1. A flameproofing synthetic fiber comprising a synthetic fiber, a halogenated cycloalkane compound (A), and a phosphorus compound (B) represented by the general formula (I):

$$R-(OCH_2CH_2)_n-O-\overset{\overset{\displaystyle O}{\|}}{\underset{\underset{\displaystyle OM}{|}}{P}}-OM$$

wherein R is an alkyl group having 6 to 30 carbon atoms on an average, each of M and M', which may be the same or different, is an alkali metal, and n is an integer of 0 to 30, and wherein said halogenated cycloalkane compound (A) and said phosphorus compound (B) represented by the general formula (I) defined hereinbefore are applied to said synthetic fiber. in an amount of 0.5 to 7% by weight of the synthetic fiber.

2. A flameproofing synthetic fiber according to claim 1, wherein the halogenated cycloalkane compound (A) and the phosphorus compound (B) represented by the general formula (I) are applied on the syntehtic fiber in an amount of 1.5 to 4.0% by weight based on the weight of the synthetic fiber.

3. A flameproofing synthetic fiber according to claim 2, wherein a ratio of the halogenated cycloalkane (A) to the phosphorus compound (B) represented by the general formula (I) is in the range of 70:30 to 98:2.

4. A flameproofing synthetic fiber according to claim 2, 3, or 1 wherein the halogenated cycloalkane compound (A) is hexabromocyclododecane.

5. A flameproofing synthetic fiber according to claim 2, 3, or 1 wherein the synthetic fiber is composed of polyester.

6. A flameproofing synthetic fiber according to claim 2, 3, or 1 wherein the synthetic fiber is crimped, having a crimp number of 10 to 18 crimps/25 mm and a percentage crimp of 8 to 38%.

* * * * *